United States Patent [19]

Lindlöf

[11] 4,293,176

[45] Oct. 6, 1981

[54] ELECTRICAL CONNECTION

[76] Inventor: Martti Lindlöf, Telakkatie 10, 06150 Porvoo 15, Finland

[21] Appl. No.: 125,659

[22] Filed: Feb. 28, 1980

[51] Int. Cl.[3] ..... H01R 4/44

[52] U.S. Cl. ..... 339/98; 339/246; 339/255 R

[58] Field of Search ..... 339/95 R, 253 L, 263 L, 339/265 R, 266 G, 266 L, 97 R, 246, 263 R, 255 R, 255 RT; 174/845, 945; 403/391, 396; 24/81 CC, 135 N

[56] References Cited

U.S. PATENT DOCUMENTS 3,012,091 12/1961 Schiffman ..... 339/265 X 3,144,506 8/1964 Gunthel ..... 339/246 X 3,248,684 4/1966 Hubbard et al. ..... 339/246 X 3,924,920 12/1975 Moscioni ..... 339/246

*Primary Examiner*—John McQuade

*Assistant Examiner*—John S. Brown

*Attorney, Agent, or Firm*—Cushman, Darby & Cushman

[57] ABSTRACT

An electric connector comprising two connector plates, each of said plates having opposite inner sides provided with toothed zones the teeth of which penetrate the insulation when clamping the connector plates toward each other. The clamping force is applied to the outer sides of the connector plates through plate springs at points located opposite the toothed zones.

4 Claims, 4 Drawing Figures

ELECTRICAL CONNECTION

This invention relates to electrical connectors for making branch tappings on distribution systems and has connection reliability as its primary object.

There are known electrical connectors having two opposed jaws adapted to receive two electrical conductors therebetween. Each jaw is provided with two zones of teeth penetrating through the insulation of the unstripped cables when the jaws are clamped against each other. In order that the clamping force shall not diminish during use, the jaws are normally C-shaped, and the central portion is often considerably thicker than the edge portions. In addition, between the head of the clamping bolt and one of the jaws, a spring plate is often provided for the same purpose.

The jaws are normally made of aluminum or an aluminum alloy because such a material has efficient electrical current-carrying capabilities, is relatively inexpensive, resistant to corrosion, and of a nature rendering it capable of being easily extruded.

However, the disadvantage of aluminum is that it tires when subjected to compression for a long time wherefore connectors whose function is solely based on the elasticity of aluminum jaws will, in the course of time, loosen and start to warm due to the impaired contact.

It is the object of the invention to provide an electrical connector which can function as a parallel, transition or branching connector and in which the force urging the jaws against each other remains substantially unchanged during the entire lifetime of the connector. This effect is according to the invention achieved so that the jaws are urged against each other by means of plate springs exerting their clamping force on the jaws along zones located at the zones of teeth. Hereby, the clamping force between the jaws and the conductors is maintained nearly entirely by means of the plate springs that can be manufactured of a material having suitable elasticity properties because, in the choice of said material, it is not necessary to take into account the current-carrying property of the material. The jaws can be fairly thin planar sheets.

The invention will more clearly appear in the following detailed description of a preferred embodiment, particularly when considered in connection with the accompanying drawings in which.

Figure 1:
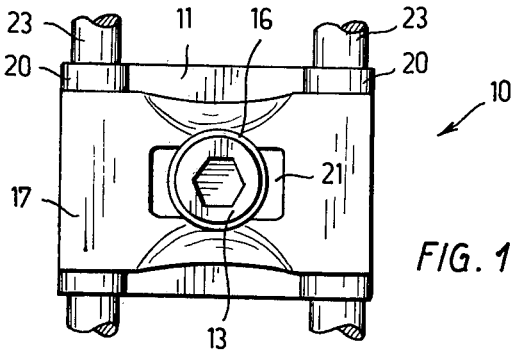
FIG. 1 is an elevational view of one side of an electrical connector according to the present invention.
Figure 2:
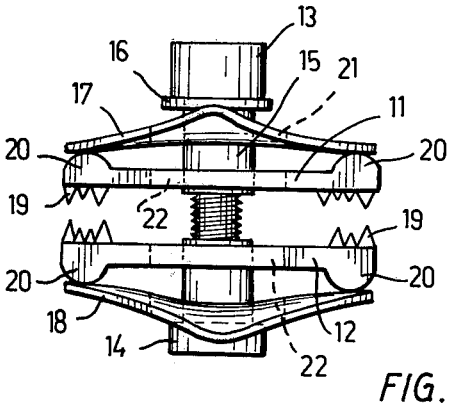
FIG. 2 is an end elevational view of the connector in a pre-mounted state.

The connector shown in the drawing is broadly denoted by the numeral 10 and includes a pair of jaws 11 and 12, and fastening means in the nature of a bolt 13 and a nut 14 threaded on the bolt interconnecting the jaws 11 and 12. In addition, the bolt 13 is surrounded by a socket 15 that is freely movably in the axial direction of the bolt and provided with an end flange 16.

Figure 4:
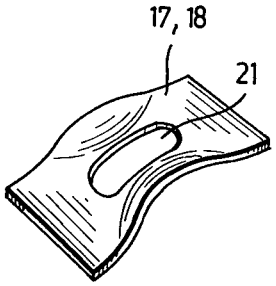
FIG. 4 is a perspective view of a plate spring.

Between the jaws 11, 12 and the end flange 16 and the nut 14, respectively, are arranged plate springs 17 and 18 which are saddle-shaped and somewhat arc-shaped, as best appears from FIG. 4. The length of the spring plates approximately corresponds to the width of the jaws so that the straight edges of the spring plates press against the edge area of the jaws. On these edge areas, the surfaces of the jaws facing each other are provided with zones of teeth having teeth 19, and the surfaces of the jaws facing away from each other are provided with beads 20 of the same length as the jaws. The jaws or at least the teeth 19 are coated with tin or nickle, and the teeth are greased in view of the sealing. Preferably, the teeth are arranged so that the teeth in the opposite zones of teeth interlap in which case the connector can also be used for small conductor diameters. The plate springs and jaws are provided with openings 21 and 22 for the bolt.

When mounting an electrical connector according to the invention, insulated cables 23 are inserted between the teeth 19 whereupon the connector is clamped by turning the bolt 13 which causes the flange 16 and the nut 14 to press the straight edges of the spring plates 17, 18 against the beads 20. From these, the force is transmitted to the teeth 19 which penetrate through the insulation of the cables 23, thereby establishing an electrical contact between the conductors of the cables through the jaws 11, 12.

Figure 3:
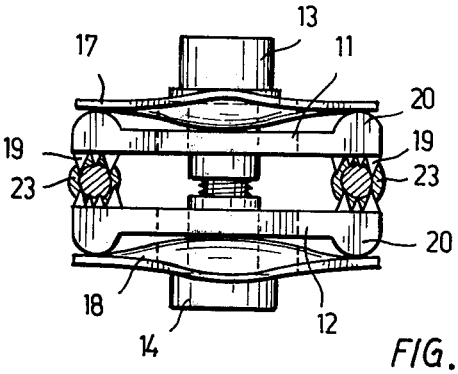
FIG. 3 is view similar to FIG. 2 showing the connector in a mounted state.

When the clamping of the bolt has been completed, the plate springs have assumed the position shown in FIG. 3 in which the ends of the springs are tightly pressed against the beads and their central portion contacts the central portion of the jaws around the hole 22. This contact ensures the continuance of the clamping force of the connector also in the case that the spring 17 has broken off. The contact pressure can be increased by surrounding the hole 22 of the jaws with a bead located on the same side as the beads 20, or by placing a washer between the spring and jaw around the bolt.

Because the plate spring does not participate in the conduction, it can be made of a suitable spring material so that it as well as possible will compensate the loosening that, in the course of time, will occur due to cold flow and will destroy the connection. This is also promoted by the fact that the spring has a long path of movement and that its clamping action is exerted directly on the edge areas of the jaws where the teeth are located. For the last-mentioned reason, the jaws can be made of relatively thin profile bar.

As required, the connector may also be made in longer sizes having a plurality of bolts. In this case, one of the jaws is preferably long, and against this jaw are placed a plurality of short jaws, each being provided with one bolt.

What I claim is:

1. An electrical connector including two jaws, each jaw having a first side facing the other jaw and a second side facing away from the other jaw, the first side of at least one of the jaws having two approximately parallel zones of teeth and the second side of said one jaw having a bead opposite each zone of teeth, and a clamping means for said jaws, said means comprising at least one bolt extending through aligned openings in said jaws and being provided with axially spaced apart shoulders, and a plate spring located between at least one of said shoulders and the second side of said one jaw, said plate spring pressing against said beads.

2. An electrical connector as claimed in claim 1, wherein said plate spring is arc-shaped.

3. An electrical connector as claimed in claim 1, wherein the number of said plate springs is two, one for each jaw.

4. An electrical connector as claimed in claim 1, wherein each of said jaws comprises a plate having a planar body portion.

* * * * *